US008403073B2

(12) United States Patent
Tsubakimoto et al.

(10) Patent No.: US 8,403,073 B2
(45) Date of Patent: Mar. 26, 2013

(54) CHANGEOVER OPERATION DEVICE

(75) Inventors: Hiroyuki Tsubakimoto, Ritto (JP); Naotake Tanaka, Hikone (JP); Fumiaki Sekino, Hirakata (JP); Kenichiro Inagaki, Hirakata (JP); Masao Yamamoto, Yasu (JP)

(73) Assignee: Panasonic Electric Works Power Tools Co., Ltd. (JP)

( * ) Notice: Subject to any disclaimer, the term of this patent is extended or adjusted under 35 U.S.C. 154(b) by 169 days.

(21) Appl. No.: 12/656,344

(22) Filed: Jan. 27, 2010

(65) Prior Publication Data

US 2010/0186976 A1 Jul. 29, 2010

(30) Foreign Application Priority Data

Jan. 27, 2009 (JP) ..... 2009-015946

(51) Int. Cl.
*B25B 21/00* (2006.01)

(52) U.S. Cl. ..... 173/47; 173/20; 200/547; 200/322.2; 200/50.32

(58) Field of Classification Search ..... 173/20, 173/47, 48, 216, 217; 81/57.31; 74/371, 74/375; 200/16.85, 329, 332.1, 332.2
See application file for complete search history.

(56) References Cited

U.S. PATENT DOCUMENTS 4,493,223 A * 1/1985 Kishi et al. ..... 74/371
5,339,908 A * 8/1994 Yokota et al. ..... 173/216
6,186,709 B1 * 2/2001 Hsu ..... 408/241 R
6,655,470 B1 * 12/2003 Chen ..... 173/47
6,796,921 B1 * 9/2004 Buck et al. ..... 475/299
7,028,784 B2 * 4/2006 Breitenmoser ..... 173/20
2008/0098842 A1 * 5/2008 Spielmann et al. ..... 74/473.1

FOREIGN PATENT DOCUMENTS

| | | |
|---|---|---|
| DE | 4128651 | 3/1993 |
| EP | 1886768 | 2/2008 |
| JP | H05101744 | 4/1993 |
| JP | 2008-114365 | 5/2008 |

OTHER PUBLICATIONS

The extended European search report dated Feb. 2, 2011.
The Chinese Office Action dated Jul. 25, 2011 and English translation thereof.

* cited by examiner

*Primary Examiner* — M. Alexandra Elve
*Assistant Examiner* — Nathaniel Chukwurah
(74) *Attorney, Agent, or Firm* — Bacon & Thomas, PLLC

(57) ABSTRACT

A changeover operation device, for changing over the positions of at least two components to establish three or more speed modes in a speed changer mechanism accommodated within a housing having an opening, includes operation handles arranged in a corresponding relationship with the components. Each of the operation handles is movable between two specified positions along a specified operation direction to change over the positions of the components. The operation handles are continuously arranged within the opening of the housing, one of the operation handles being partially overlapped with the other.

20 Claims, 9 Drawing Sheets

CHANGEOVER OPERATION DEVICE

FIELD OF THE INVENTION

The present invention relates to a changeover operation device and, more specifically, to a changeover operation device for changing over speed modes in a speed changer mechanism with three or more speed modes.

BACKGROUND OF THE INVENTION

Conventionally, electric rotary tools such as a rotary impact tool and a drill tool are provided therein with a speed reducer mechanism capable of changing output rotation speed in three or more stages.

As a changeover unit for changing over the rotation speed of the speed reducer mechanism, there is known a changeover operation device as disclosed in, e.g., Japanese Patent Laid-open Publication No. 2008-114365. This changeover operation device includes a single slide switch (equivalent to operation handles employed in the present invention) that can be slid into three shift positions, thereby shifting two shiftable gears and changing over three speed modes.

In the changeover operation device of Japanese Patent Laid-open Publication No. 2008-114365, the two shiftable gears are shifted by sliding the single slide switch. For this reason, one of the three shift positions necessarily becomes an intermediate position from which the slide switch can be slid toward the remaining two shift positions.

Therefore, the slide switch may be slid excessively or insufficiently. This makes it difficult to keep the slide switch in the intermediate position, thus impairing the ease of use.

SUMMARY OF THE INVENTION

In view of the above, the present invention provides a changeover operation device that enjoys improved operability and enhanced ease of use by removing an intermediate position which would otherwise need to be assumed by an operation switch.

In accordance with an aspect of the invention, there is provided a changeover operation device for changing over the positions of at least two components to establish three or more speed modes in a speed changer mechanism accommodated within a housing having an opening, including: operation handles arranged in a corresponding relationship with the components, each of the operation handles being movable between two specified positions along a specified operation direction to change over the positions of the components, the operation handles being continuously arranged within the opening of the housing, one of the operation handles being partially overlapped with the other.

With this configuration, there is no need to keep the operation handles in an intermediate position, as distinguished from the conventional changeover operation device in which the positions of two components are changed over by a single operation handle.

Since the operation handles are overlapped with each other, it is possible to suppress an increase in the total length of the changeover operation device measured along the operation direction.

With such configuration, there is no need to keep the handles in an intermediate position. This makes it possible for a user to securely place the operation handles at the respective mode positions, to easily perceive the stop positions of the operation handles and to easily perform the changeover operation of the positions of the operation handles, thereby enhancing the ease of use of the changeover operation device.

Since the operation handles are overlapped with each other, it is possible to suppress an increase in the total length of the changeover operation device. This helps prevent the changeover operation device from being increased in size.

In the changeover operation device, each of the operation handles may include a hidden portion selectively exposed in each of the speed modes, the hidden portion being provided with a mode indicating portion indicative of one of the speed modes.

With such configuration, the mode indicating portion corresponding to each of the speed modes can be visually recognized. This makes it possible for a user to easily perceive the current mode by merely seeing the mode indicating portion, thereby enhancing the ease of use of the changeover operation device.

In the changeover operation device, the housing may include marks provided in alignment with the two specified positions of the operation handles.

With such configuration, the stop positions of the operation handles during the changeover operation can be easily decided by merely bringing the operation handles into alignment with the marks. This helps enhance the ease of use of the changeover operation device.

In the changeover operation device, the housing may include opposite side areas extending parallel to the operation direction to define the opening, the marks being arranged in the opposite side areas in a corresponding relationship with each of the operation handles.

With such configuration, the marks are arranged in the opposite side areas in a corresponding relationship with each of the operation handles. This eliminates the possibility that a user confuses the marks for one of the operation handles with the marks for the other operation handle. Therefore, it is possible for a user to easily perceive the stop positions of the operation handles during the changeover operation, thereby enhancing ease of use of the changeover operation device.

In the changeover operation device, the operation handles may differ in color from each other.

With such configuration, the operation handles differ in color from each other. Therefore, it is possible for a user to easily distinguish the operation handles. This helps enhance the operability and the ease of use of the changeover operation device.

In the changeover operation device, the operation handles may differ in shape from each other.

With such configuration, the operation handles differ in shape from each other. Therefore, it is possible for a user to easily perceive the current speed mode and the currently operable operation handle. This helps enhance the ease of use of the changeover operation device.

In the changeover operation device, the operation handles may be overlapped with each other over a length greater than an operation stroke.

With such configuration, the operation handles are overlapped with each other over a length greater than an operation stroke. Therefore, no gap is generated between the operation handles even if the operation handles are released from the overlapped state. This reduces the possibility that dust or other alien matters is infiltrated into the interior of the housing through the opening, thereby suppressing occurrence of trouble in the changeover operation device.

In the changeover operation device, each of the operation handles may be movable between the two specified positions with the same operation stroke.

With such configuration, each of the operation handles is movable between the two specified positions with the same operation stroke. Therefore, it is possible to simultaneously operate the operation handles and to change over the current mode to any other mode through the one-time operation of the operation handles.

BRIEF DESCRIPTION OF THE DRAWINGS

The objects and features of the present invention will become apparent from the following description of embodiments, given in conjunction with the accompanying drawings, in which.

DETAILED DESCRIPTION OF THE PREFERRED EMBODIMENTS

Hereinafter, preferred embodiments of the present invention will be described with reference to the accompanying drawings.

Figure 1:
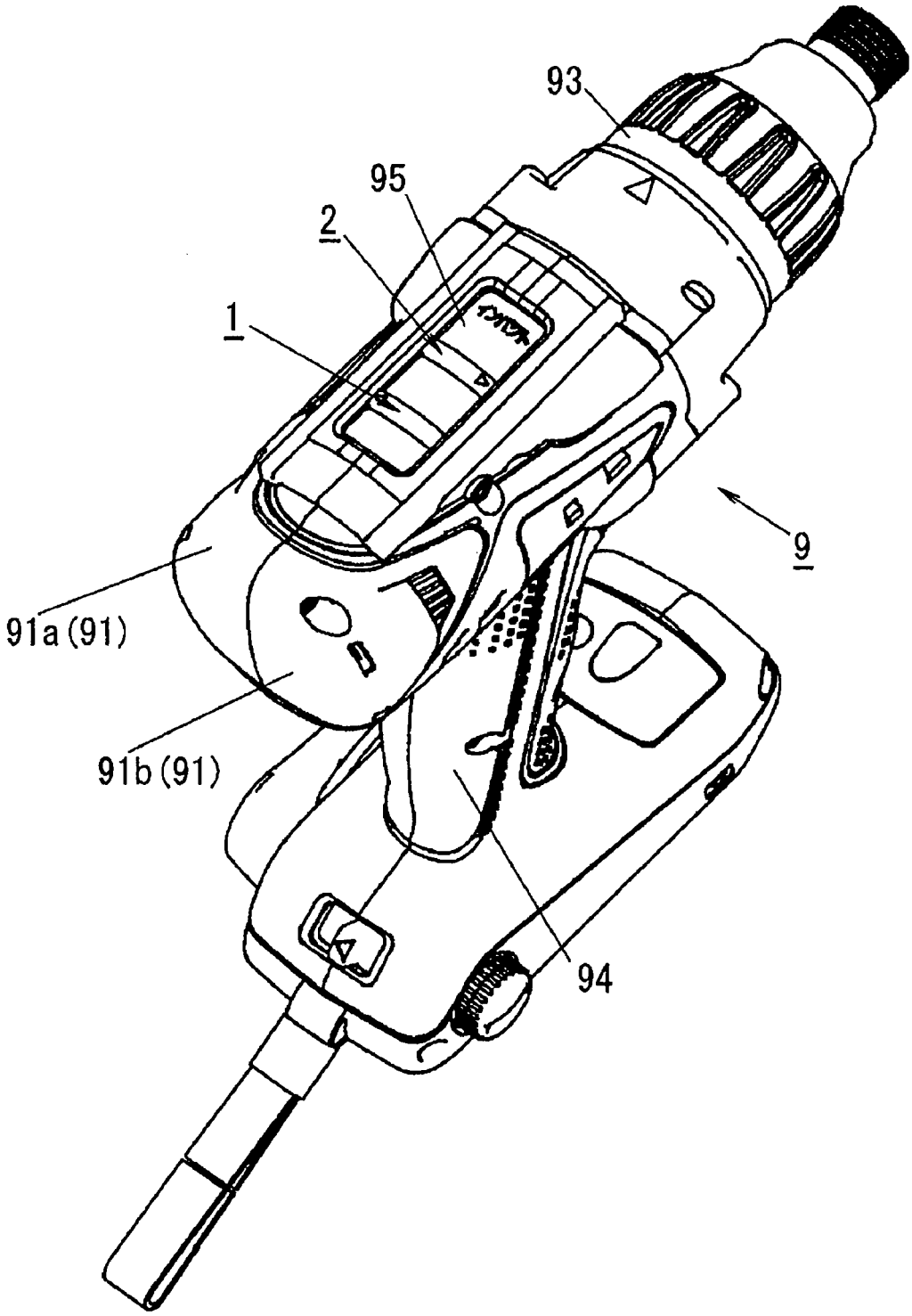
FIG. 1A is a perspective view showing a rotary impact tool including a housing with an opening and a changeover operation device in accordance with a first embodiment of the present invention, the changeover operation device being arranged within the opening of the housing.
Figure 2A:
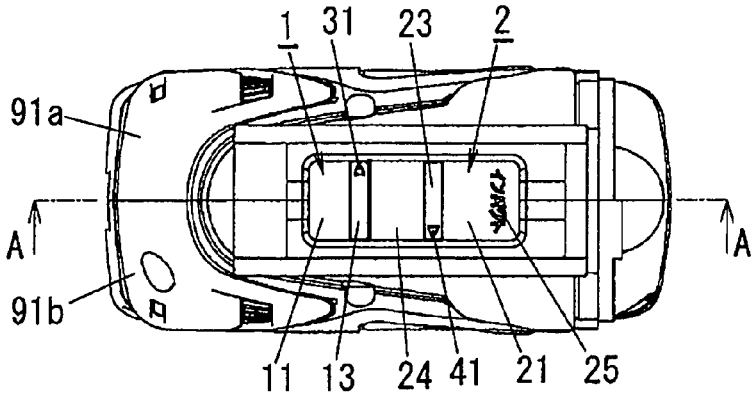
FIGS. 2A and 2B are top plan and side views of the rotary impact tool from which an output unit is removed for simplicity.
Figure 2B:
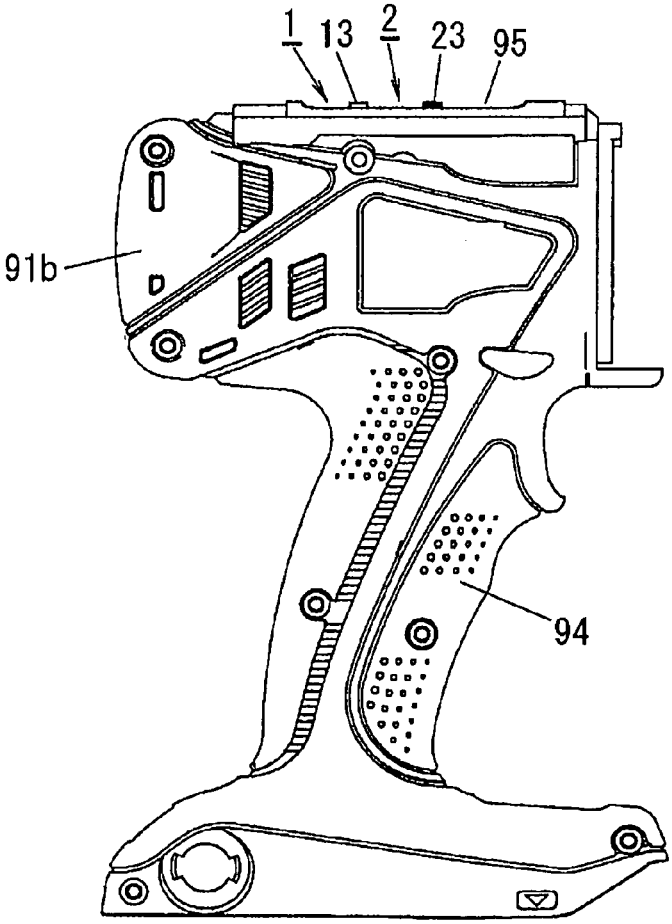
Figure 3A:
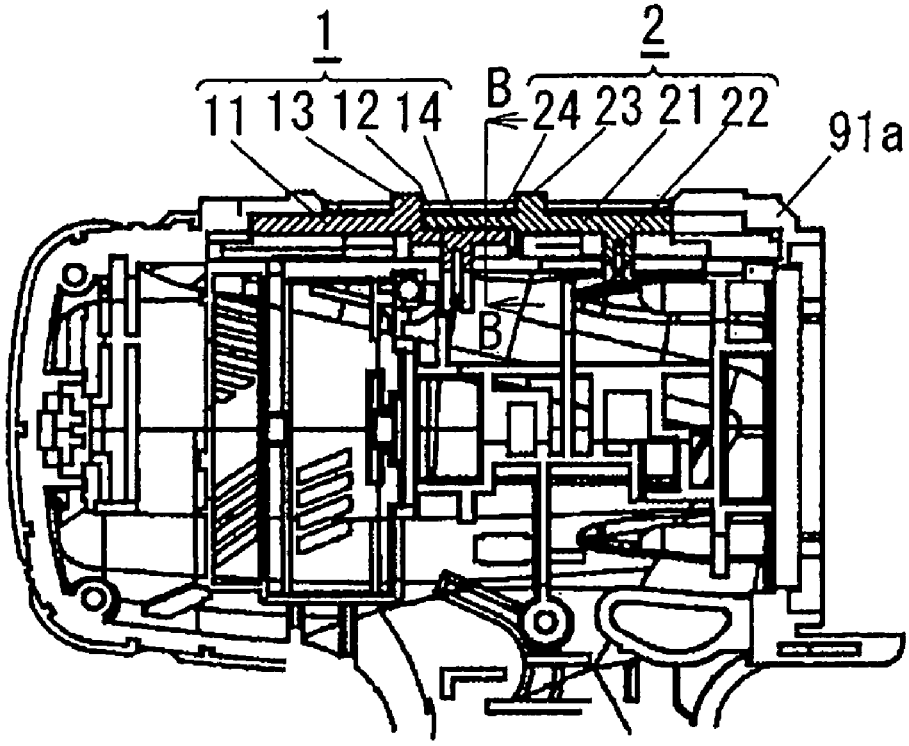
FIG. 3A is a section view taken along line A-A in FIG. 2A
Figure 3B:
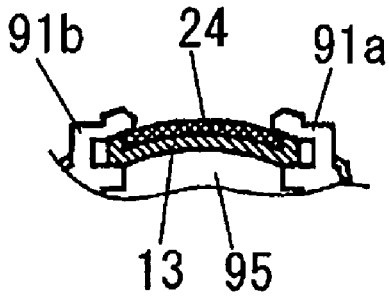
FIG. 3B is a section view taken along line B-B in FIG. 3A, in which views the changeover operation device is arranged in a first mode in the housing of the rotary impact tool.
Figure 4A:
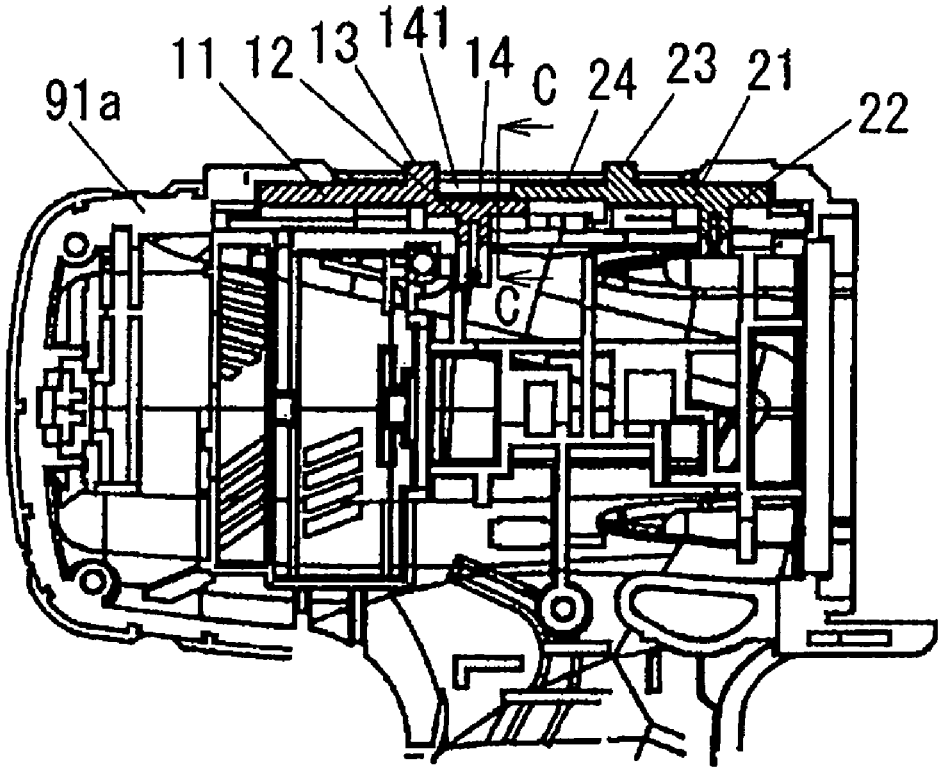
FIG. 4A is a section view taken along line A-A in FIG. 2A
Figure 4B:
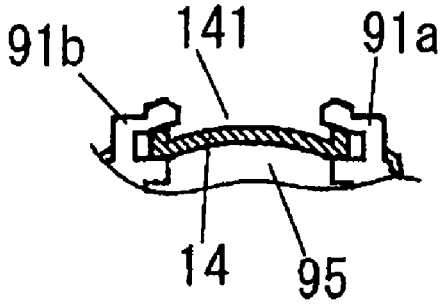
FIG. 4B is a section view taken along line C-C in FIG. 4A, in which views the changeover operation device is arranged in a second mode in the housing of the rotary impact tool.

Referring to FIGS. 1 to 2B, a changeover operation device according to the present invention is arranged within an opening 95 defined on one surface of, for example, a rotary impact tool 9, for example.

The rotary impact tool 9 includes a bisected housing (91*a* and 91*b*) and a speed reducer mechanism 92 arranged inside the housing 91. The speed reducer mechanism 92 can be changed over into three different modes. The speed reducer mechanism 92 serves to reduce the speed of the rotational movement inputted from a drive power source.

The rotational movement, the speed of which has been reduced by the speed reducer mechanism 92 to match with the reduction ratio of each of the modes, is transferred to an output unit 93. The output unit 93 is arranged at one end of the housing 91 and is provided with an impact mechanism.

A grip unit 94 having an electric power source built therein is provided to extend from the opposite surface of the housing 91 from the opening 95.

The opening 95 is formed into an elongated rectangular shape extending in the axial direction of a rotating shaft of the speed reducer mechanism 92. Alternatively, the opening 95 may be formed into a substantially equilateral square shape.

In the following description, the direction in which the rotational movement is outputted from the speed reducer mechanism 92, namely the side on which the output unit 93 lies, will be referred to as forward, and the reverse direction as backward. The side on which the grip unit 94 lies will be referred to as downward, while the side on which the opening 95 lies will be referred to as upward. The direction perpendicular to the back-and-forth direction and the up-and-down direction will be referred to as transverse.

The speed reducer mechanism 92 includes first and second speed changer units (not shown) that can be shifted over into a reduction state and a non-reduction state. The speed of the rotational movement outputted can be changed over between three speeds by combining the shift operations of the first and second speed changer units.

The first and second speed changer units are shifted into the reduction state and the non-reduction state by a changeover operation device. The operations of the speed changer units are not limited to the shift operations between the reduction state and the non-reduction state. Alternatively, the speed changer units may be shifted into two different reduction ratios or into a use state and a non-use state.

Referring to FIGS. 3A to 4B, the changeover operation device includes a first handle 1 for performing the shift operation of the first speed changer unit and a second handle 2 for performing the shift operation of the second speed changer unit. The first handle 1 and the second handle 2 are arranged within the opening 95 defined in the housing 91.

The first handle 1 includes a first body plate 11 held within the housing 91 for back-and-forth sliding movement along the opening 95 in the axial direction, a first coupling portion 12 extending downwards from the first body plate 11 for engagement with the first speed changer unit and a first handle operation portion 13 protruding upwards from the first body plate 11.

As the first body plate 11 makes sliding movement, the first handle 1 is moved into a front position and a rear position. Upon the back-and-forth movement of the first handle 1 between the front position and the rear position, the first coupling portion 12 changes over the reduction state and the non-reduction state.

When the first handle 1 is in the front position, the rear portion of the first body plate 11 is positioned within the opening 95 with a portion thereof held inside the housing 91. When the first handle 1 is in the rear position, however, the rear portion of the first body plate 11 is positioned at the rear side of the opening 95 and hidden inside the housing 91. On the upper surface of the first body plate 11, there is provided a third mode indicating portion 15 that can be visually recognized from the outside only when the first handle 1 is in the front position. The front and rear positions of the first handle 1 are decided by stopper ribs (not shown) formed inside the housing 91.

The front portion of the first body plate 11 is formed of a first overlap portion 14 having a recess 141 on its upper front side. The rear portion of the second handle 2 is arranged above the first overlap portion 14.

By fitting the rear position of the second handle 2 into the recess 141, the first overlap portion 14 is hidden under the second handle 2. Thus, the first handle 1 and the second handle 2 are overlapped with each other.

A second mode indicating portion 16 is formed on the upper surface of the first overlap portion 14 defining the recess 141. The second mode indicating portion 16 can be visually recognized when the first handle 1 is in the rear position and the rear portion of the second handle 2 is not overlapped with the first handle 1.

The second handle 2 is positioned within the opening 95 together with the first handle 1. Therefore, the second handle 2 other than the rear portion thereof overlapped with the first overlap portion 14 is always slid forwards and backwards in the axial direction at the front side of the first handle 1.

Just like the first handle 1, the second handle 2 includes a second body plate 21 slidably held within the housing 91, a second coupling portion 22 extending downwards from the second body plate 21 for engagement with the second speed changer unit and a second handle operation portion 23 protruding upwards from the second body plate 21.

As the second body plate 21 makes sliding movement, the second handle 2 is moved into a front position and a rear position. Upon its back-and-forth movement, the second handle 2 performs the shift operation of the second speed changer unit. The front and rear positions of the second handle 2 are decided by stopper ribs (not shown) formed inside the housing 91.

The rear portion of the second body plate 21 is formed of a second overlap portion 24 that can move into and out of the recess 141 of the first overlap portion 14. The second overlap portion 24 is positioned above the first overlap portion 14 when it is moved into the recess 141 of the first overlap portion 14.

When the second overlap portion 24 is positioned above the first overlap portion 14, the first handle 1 and the second handle 2 is partially overlapped with each other, thereby covering and hiding the second mode indicating portion 16 formed on the upper surface of the first overlap portion 14.

A first mode indicating portion 25 is formed on the upper surface of the front portion of the second handle 2. When the second handle 2 in the front position, the first mode indicating portion 25 is positioned at the front side of the opening 95 and hidden inside the housing 91. When the second handle 2 is in the rear position, the first mode indicating portion 25 lies in the opening 95 and becomes visually recognizable.

Thus, the speed reducer mechanism 92 can be changed over into three modes, namely a first mode in which the first handle 1 and the second handle 2 are all in the rear position, a second mode in which the first handle 1 is in the rear position and the second handle 2 is in the front position and a third mode in which the first handle 1 and the second handle 2 are all in the front position.

In the present embodiment, the first mode is an impact mode in which an impact mechanism gets activated. The second mode is a drill driver low mode in which the output speed becomes lowest. The third mode is a drill driver high mode in which the output speed goes between the output speeds of the former two modes.

The first handle 1 and the second handle 2 are arranged within the opening 95 so that the upper surface of the first body plate 11 other than the first overlap portion 14, the upper surface of the second body plate 21 and the upper surface of the second overlap portion 24 can be flush with each other.

In case no overlap portion is provided, a mode in which the first handle is in the front position and the second handle is in the rear position may be set. When such a mode is not necessary, a restriction mechanism is required to prevent a user from setting such a mode. In contrast, in accordance with the present invention, it is possible to perform the restriction of the operation without adding any new part, so that the changeover operation device has a low production cost and an increased assembility. Further, although the rotary impact tool has three operation modes in the present embodiment, the same effects can be obtained in the case of a rotary impact tool having a four or more operation modes, or in the case of other tools than the rotary impact tool.

Next, the correspondence to the modes in the operation of the first handle 1 and the second handle 2 and the visual recognizability of the respective mode marks in each of the modes will be described with reference to FIGS. 5A to 5C.

Figure 5A:
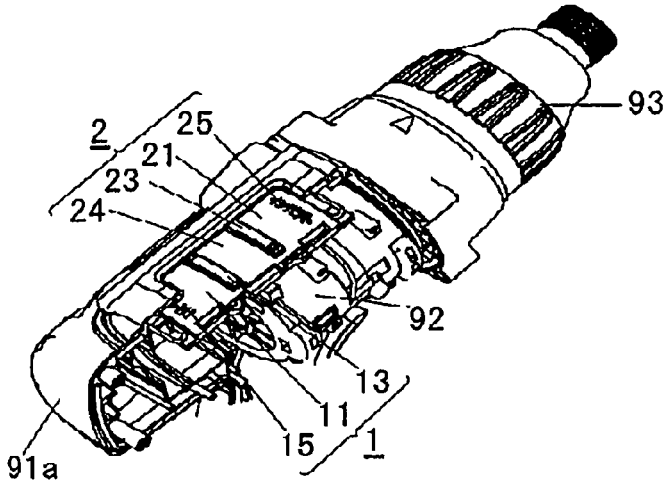
FIGS. 5A, 5B and 5C are partially cutaway perspective views of the rotary impact tool illustrating the changeover operation device in a first mode, a second mode and a third mode, respectively.

If the first handle 1 and the second handle 2 are all in the rear position as shown in FIG. 5A, the first overlap portion 14 and the second overlap portion 24 are overlapped with each other. Therefore, the rear portion of the first handle 1 is hidden inside the housing 91, making it impossible to visually recognize the third mode indicating portion 15 and the second mode indicating portion 16 from the outside.

However, the first mode indicating portion 25 of the front portion of the second handle 2 is positioned in the opening 95 and can be visually recognized from the outside. The first mode indicating portion 25 indicates the impact mode.

In the first mode in which the first handle 1 and the second handle 2 are all in the rear position, therefore, a user can easily see from the marking of the first mode indicating portion 25 that the speed reducer mechanism 92 is in the impact mode.

Figure 5B:
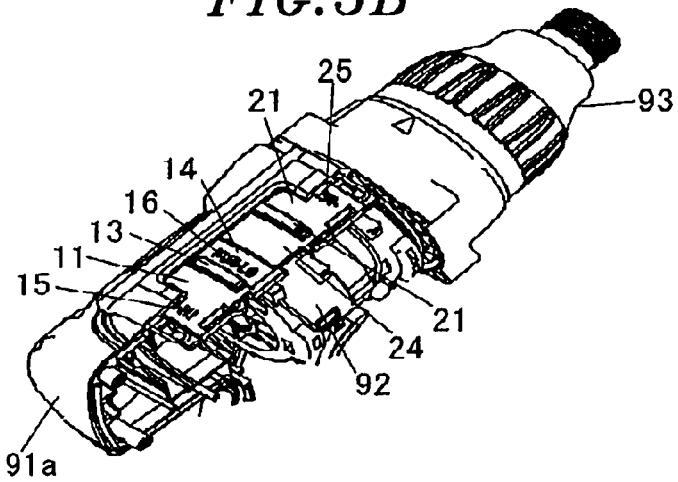

If the second handle 2 is slid into the front position as shown in FIG. 5B to perform the changeover operation to the second mode, the front portion of the second handle 2 is hidden inside the housing 91. This makes it impossible to visually recognize the first mode indicating portion 25 from the outside.

At this time, the first overlap portion 14 and the second overlap portion 24 are released from the overlapped state, consequently exposing the upper surface of the first overlap portion 14 to the outside. Therefore, it becomes possible to visually recognize the second mode indicating portion 16 indicative of the drill driver low mode.

The first overlap portion 14 and the second overlap portion 24 are not completely released from the overlapped state but remain partially overlapped at their end extensions. This prevents the possibility that the interior of the housing 91 is exposed in the opening 95 through a gap which would otherwise be generated between the front end of the first handle 1 and the rear end of the second handle 2.

In the second mode in which the first handle 1 is in the rear position and the second handle 2 is in the front position, therefore, a user can easily confirm from the marking of the second mode indicating portion 16 that the speed reducer mechanism 92 is in the drill driver low mode.

Figure 5C:
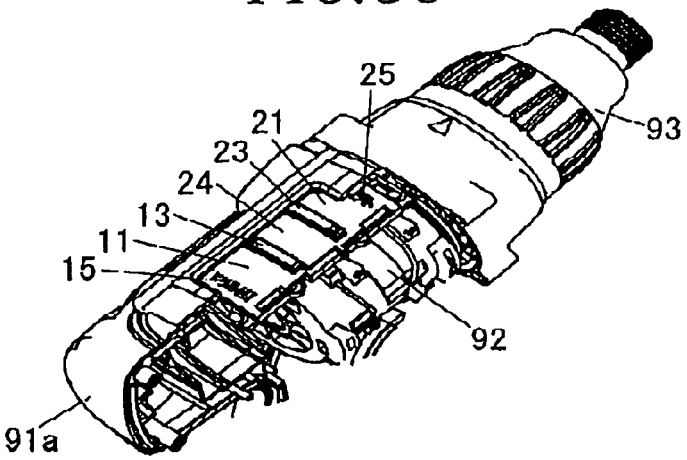

If the first handle 1 is slid into the front position as shown in FIG. 5C to perform the changeover operation from the second mode to the third mode, the rear portion of the first handle 1 is situated in the opening 95. This makes it possible to visually recognize the third mode indicating portion 15 from the outside.

At this time, the first overlap portion 14 is positioned below and overlapped with the second overlap portion 24. Thus, the upper surface of the first overlap portion 14 defining the recess 141 is covered by the second overlap portion 24. This makes it impossible to visually recognize the second mode indicating portion 16 from the outside.

In the third mode in which the first handle 1 and the second handle 2 are in the front position, therefore, a user can easily confirm from the marking of the third mode indicating portion 15 that the speed reducer mechanism 92 is in the drill driver high mode.

Next, the changeover stroke of the changeover operation device in the three modes will be described using the changes in the distance L1 between the first handle operation portion 13 and the rear end of the opening 95, the distance L2 between the first handle operation portion 13 and the second handle operation portion 23, and the distance L3 between the second handle operation portion 23 and the front end of the opening 95.

Figure 6A:
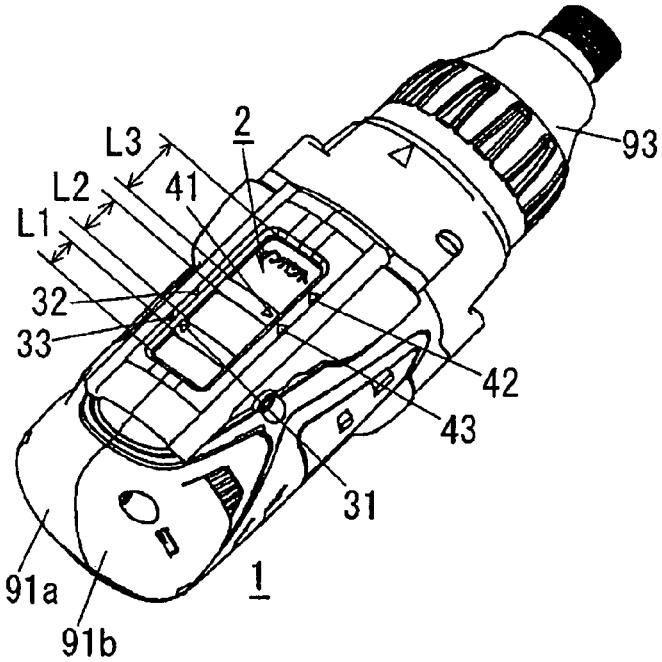
FIGS. 6A, 6B and 6C are perspective views of the rotary impact tool illustrating the positional relationship between handle-side marks and reference marks in the first mode, the second mode and the third mode, respectively.

As shown in FIG. 6A, the distance L3 is greatest in the first mode in which the first handle 1 and the second handle 2 are in the rear position.

Figure 6B:
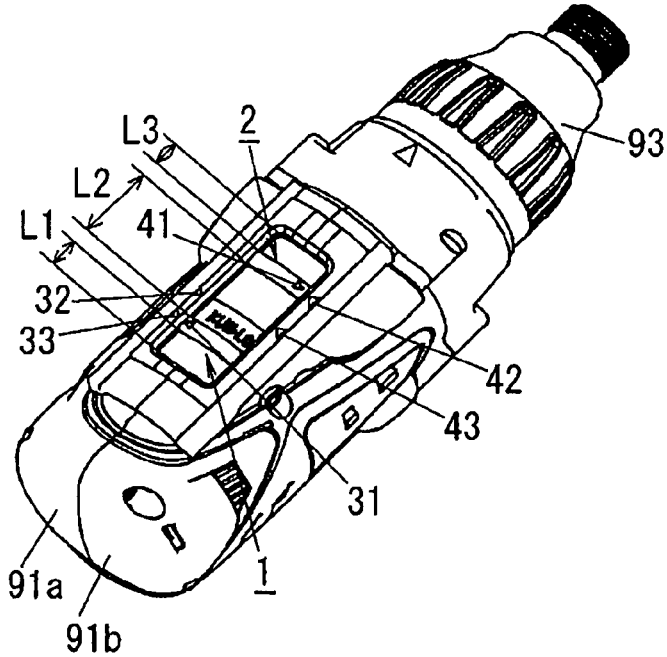

If the second handle 2 is moved forwards to establish the second mode as shown in FIG. 6B, the distance L3 becomes substantially equal to the distance L1. The distance L2 is increased in proportion to the decrease in the distance L3. Thus, the distance L2 becomes greatest.

Figure 6C:
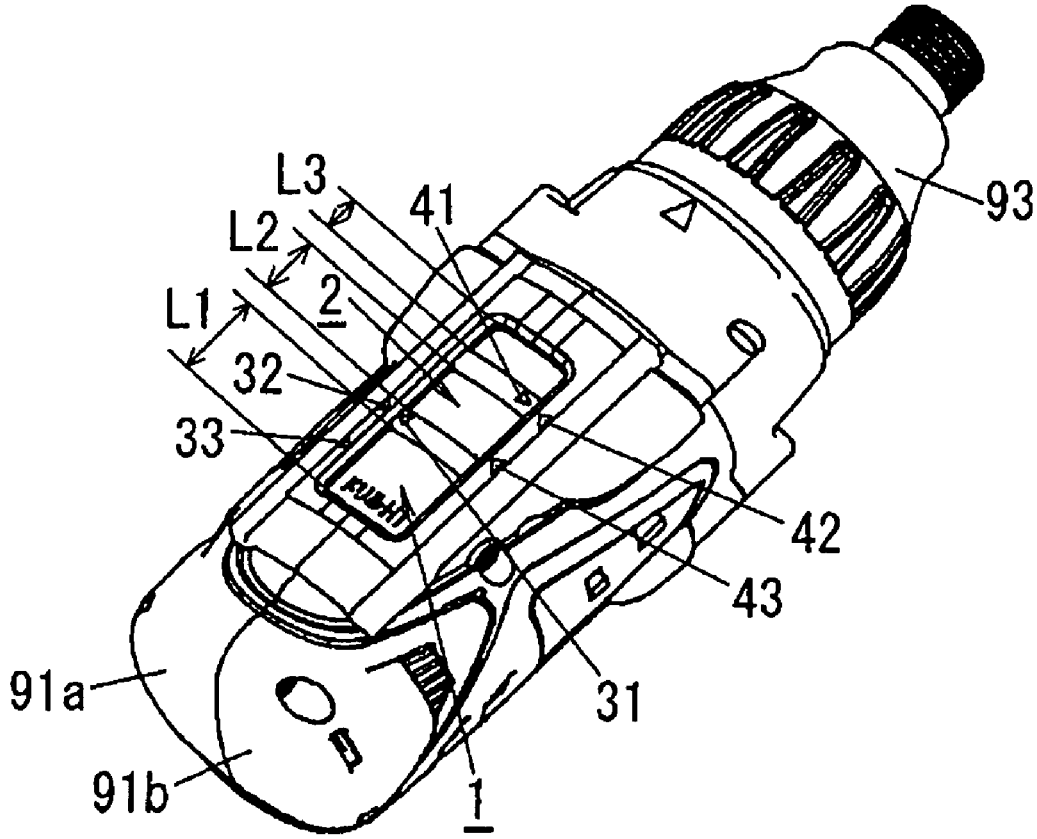

If the first handle 1 is moved forwards to establish the third mode as shown in FIG. 6C, the distance L2 becomes equal to the distance L2 available in the first mode. The distance L1 is increased in proportion to the decrease in the distance L2. Thus, the distance L1 becomes greatest.

The relationship between the distance L1 and the distance L3 available when the first handle 1 and the second handle 2 are all in the front position is inverse to that available when the first handle 1 and the second handle 2 are all in the rear position. The length changed by operation of the respective handles 1 and 2 is kept substantially constant.

The length changed as above corresponds to the moving distance of the respective handles 1 and 2 when they are operated once. This means that the changeover strokes during the changeover operation of the respective modes are equal to one another and the two handles can be operated at the same time. Therefore, it is possible to change over, for example, between the impact mode and the drill driver high mode through the one-time operation of the handles 1 and 2. In other words, it is possible to change over the current mode to any other mode through the one-time operation of the respective handles 1 and 2.

One of the distances L1, L2 and L3, over which the handle 1 or 2 can be operated, is kept longest at the normal time. This enables a user to easily recognize the handle 1 or 2 that permits the changeover operation.

A first handle side mark 31 is provided in the left end area of the upper surface of the first handle operation portion 13 of the first handle 1. A second handle side mark 41 is provided in the right end area of the upper surface of the second handle operation portion 23 of the second handle 2.

In the left half part 91*a* of the housing 91, there are provided a first front reference mark 32 that comes into transverse alignment with the first handle side mark 31 when the first handle 1 is in the front position and a first rear reference mark 33 that comes into transverse alignment with the first handle side mark 31 when the first handle 1 is in the rear position.

If the first handle side mark 31 is aligned with one of the first front reference mark 32 and the first rear reference mark 33, a user can visually recognize from the outside that the first handle 1 has been slid into the front position or the rear position to successfully complete the changeover operation.

In the right half part 91*b* of the housing 91, there are provided a second front reference mark 42 that comes into transverse alignment with the second handle side mark 41 when the second handle 2 is in the front position and a second rear reference mark 43 that comes into transverse alignment with the second handle side mark 41 when the second handle 2 is in the rear position.

If the second handle side mark 41 is aligned with one of the second front reference mark 42 and the second rear reference mark 43, a user can visually recognize from the outside that the changeover operation been successfully completed by the second handle 2.

Accordingly, the speed reducer mechanism 92 can be shifted into one of the three modes by combining the two handles moveable into the front position and the rear position. The handles can be easily moved into the positions where the respective modes are changed over. This assists in enhancing the ease of use of the changeover operation device.

The respective handles are designed to make sliding movement into one of the two positions, i.e., the front position and the rear position. This eliminates the need to keep the handles in an intermediate position between the front position and the rear position.

Since the positions of the respective handles are decided by the stopper ribs of the housing 91 during the movement into the front position and the rear position, it is possible for a user to easily decide the stop positions of the respective handles. This restrains the handles from being moved into a position where the respective modes are not available. Therefore, it is easy to keep the handles in their positions, which assists in preventing erroneous operation of the handles.

Owing to the fact that the handles are arranged in the same opening 95, it is possible to reduce the number of cutout portions which are needed to form the opening 95 in the housing 91. Even if a shock is applied to the rotary impact tool 9 by the dropping thereof or other causes, it is possible to reduce the number of stress-concentrated portions generated in the housing 91. This assists in preventing occurrence of trouble or other problems.

As can be seen in FIGS. 5B and 6B illustrating the second mode, the total sum of the longitudinal dimensions of the first handle 1 and the second handle 2 measured in the axial direction is set greater than the back-and-forth length of the opening 95 so that the handles 1 and 2 can cover the entire area of the opening 95.

The handles 1 and 2 are partially overlapped with each other and, therefore, can make sliding movement while covering the opening 95. The second overlap portion 24 is overlapped with the upper surface of the first overlap portion 14.

No other component than the first handle 1 and the second handle 2 is arranged in the opening 95. This helps suppress an increase of the number of parts and avoid complexity in the configuration and assembling task of the changeover operation device. By only the two parts, it is possible to prevent an exposure of the inside of the rotary impact tool and an invasion of a foreign material into the rotary impact tool.

Provision of the overlap portions makes it possible to suppress an increase in the back-and-forth length of the changeover operation device and the opening 95, thereby suppressing an increase in the size of a rotary tool and restricting the changeover operation to an unnecessary mode without increasing the number of parts.

Since the mode indicating portions are provided in the housing 91 and the portions of the handles whose visual recognizability is changed by the overlap portions, it is possible to provide a mode indicating unit in a cost-effective manner. The mode indicating portions are changed in response to the mode changeover operation. One of the mode indicating portions is visually recognizable in each of the modes.

Therefore, the current mode can be easily identified by merely seeing the visually recognizable mode indicating portion.

Provision of the handle side marks in the respective handle operation portions and provision of the reference marks in the housing makes it possible for a user to easily decide the stop positions of the handle operation portions during their sliding movement.

Since the reference marks are arranged in the left and right housing parts 91*a* and 91*b* in a corresponding relationship with the first handle 1 and the second handle 2, it is possible for a user to easily see the current positions of the respective handle operation portions.

The reference marks corresponding to the respective handles are provided in the different housing parts of the housing 91. Therefore, it is possible for a user to easily identify the first front reference mark 32 indicative of the front position of the first handle 1 and the second rear reference mark 43 indicative of the rear position of the second handle 2.

Needless to say, the positions of the reference marks may be changed insofar as the reference marks are separately provided in the left and right positions in a corresponding relationship with the first handle 1 and the second handle 2. The housing 91 may not be divided into two parts but may be formed into a single body.

One of the distance between the rear end of the opening 95 and the first handle operation portion 13, the distance between the first handle operation portion 13 and the second handle operation portion 23 and the distance between the second handle operation portion 23 and the front end of the opening 95 becomes greatest in each of the modes.

This means that the first handle operation portion 13 or the second handle operation portion 23 having the greatest distance is a slidable one. Therefore, it is possible for a user to easily perceive the currently operable handle and the slidable direction thereof.

Since the changeover strokes, i.e., the moving distances of the respective handle operation portions during the changeover operation, are set substantially equal to one another, the two handle operation portions can be simultaneously operated in the first mode or the third mode. This helps enhance the ease of use of the changeover operation device.

It is desirable that the colors of the first handle 1 and the second handle 2 differ from each other. In this case, the colors of the respective handle operation portions become different, thereby making it possible to easily distinguish the respective handles and to enhance the ease of use of the changeover operation device.

The changeover operations performed by the respective handles of the changeover operation device are not limited to the axial sliding movement. Alternatively, the respective handles may be configured to rotate about the axis of the rotary tool to perform the shift operation of the speed reducer mechanism.

Figure 7A:
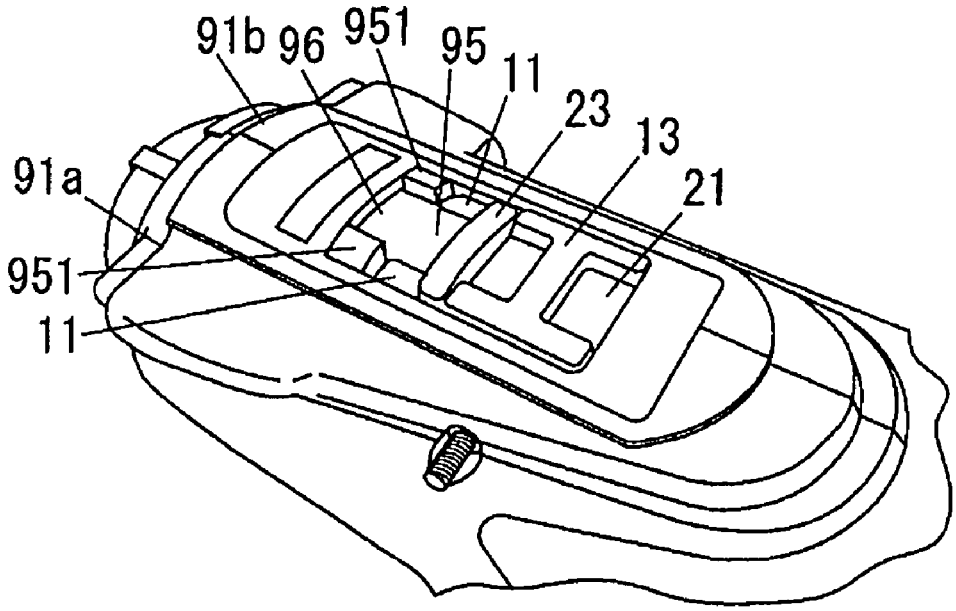
FIGS. 7A, 7B and 7C are partially cutaway perspective views of the rotary impact tool illustrating a changeover operation device in accordance with a second embodiment of the present invention kept in the first mode, the second mode and the third mode, respectively.
Figure 7B:
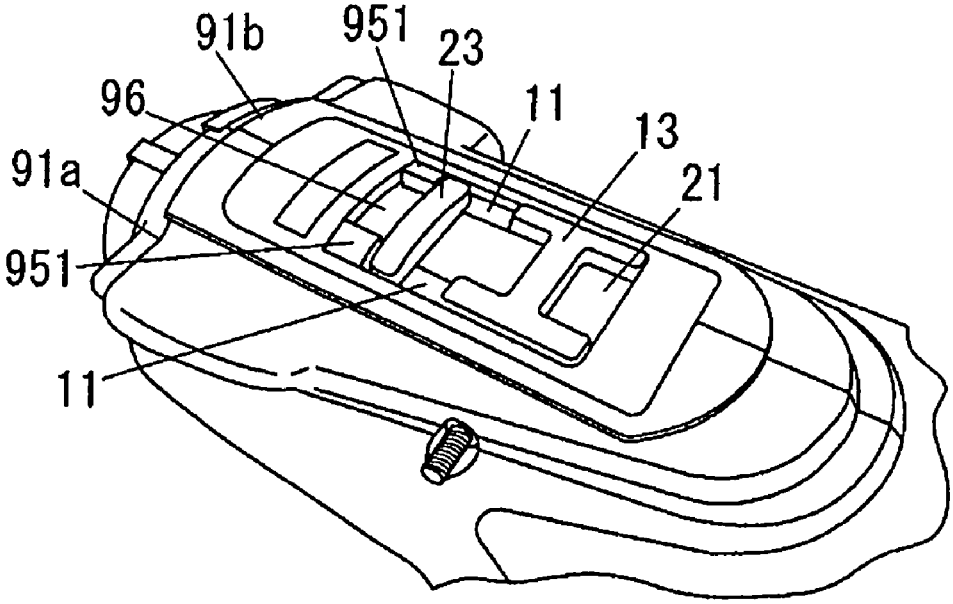
Figure 7C:
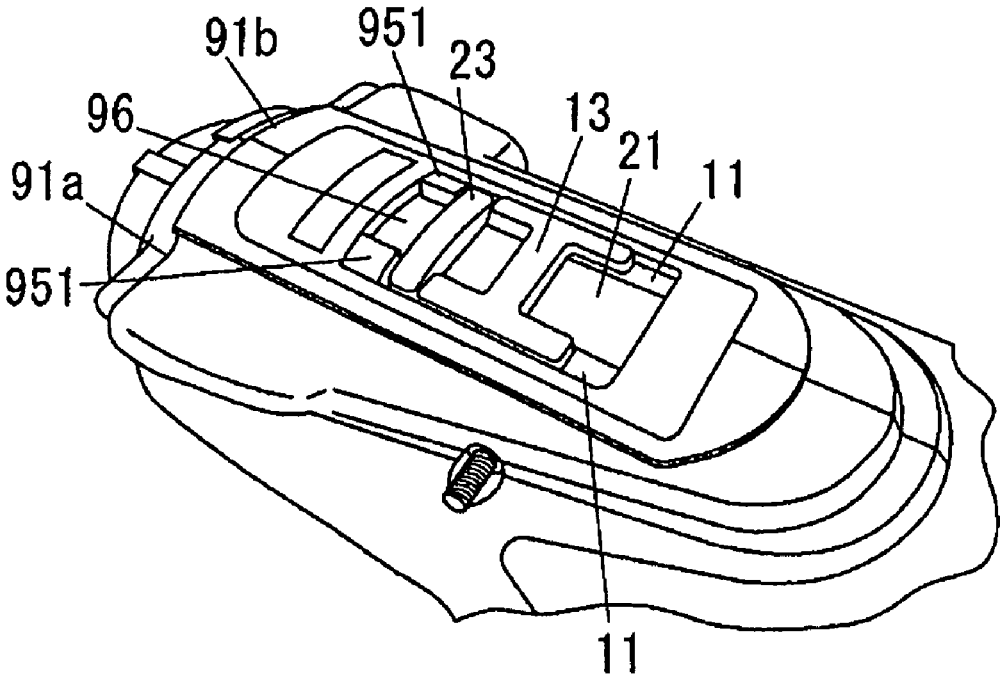

Referring to FIGS. 7A to 7C, there is shown a changeover operation device in accordance with a second embodiment of the present invention, in which device the first handle 1 and the second handle 2 differ in shape from each other. Only the points differing from the changeover operation device of the first embodiment will be described with the same configuration omitted from description.

When viewed from above, the first handle 1 includes two "I"-shaped first body plates 11, each of which has a front portion and a rear portion extending in the sliding direction, and an "H"-shaped first handle operation portion 13 bridging the two first body plates 11.

The second handle 2 includes an axially slidable "I"-shaped second body plate 21 arranged between the two first body plates 11 of the first handle 1 and a second handle operation portion 23 attached to the second body plate 21, the second handle operation portion 23 having a transverse dimension generally equal to the transverse width of the opening 95.

The back-and-forth length of the first handle 1 and the second handle 2 is greater than that of the opening 95. A portion of the second body plate 21 is always positioned below the first handle operation portion 13. Likewise, certain portions of the first body plates 11 are always situated below the left and right end portions of the second handle operation portion 23.

Therefore, the respective handles can cover the opening 95 at all times independently of the position thereof, thus preventing dust or other alien matters from infiltrating into the interior of the rotary tool through the opening 95.

Although not shown in the drawings, the first handle 1 further includes first overlap portions transversely extending from the lower surfaces of the two first body plates 11 toward the underside of the second body plate 21 in such positions as not to hinder the shift operation of the second coupling portion.

The first overlap portions serve to prevent bending deformation of the first handle operation portion 13 and misalignment of the two first body plates 11, which would otherwise be caused by the pressing force applied during the operation of the first handle operation portion 13. The first overlap portions also serve to prevent the second handle 2 from dropping into the interior of the rotary tool.

A forwardly depressed recess 96 having a transverse width smaller than that of the opening 95 is formed at the front end of the opening 95. The recess 96 enables a user to easily grip the second handle operation portion 23 even when the second handle 2 is in the front position.

When the second handle 2 is moved into the front position, the stop position of the second handle 2 is decided by a stopper rib formed inside the housing 91 so that the second handle 2 can stop if the left and right end portions of the second handle operation portion 23 make contact with the rear surfaces of opposite lateral portions 951 of the recess 96.

Since the second handle operation portion 23 comes into contact with the opposite lateral portions 951 when the second handle 2 is slid into the front position, it is possible for a user to easily perceive the front position of the second handle 2.

If the first handle 1 is slid forwards when the second handle 2 is in the front position, the stop position of the first handle 1 is decided by a stopper rib formed inside the housing 91 so that the first handle 1 can stop if the front end of the first handle operation portion 13 makes contact with the rear surfaces of the left and right end portions of the second handle operation portion 23. This makes it possible for a user to perceive the front position of the first handle 1 with ease.

Since the first handle operation portion 13 and the second handle operation portion 23 differ in shape from each other, the shape of indented spaces created in the opening 95 varies depending on the position of the respective handle operation portions in each of the modes. Due to the difference in the shape of indented spaces, it is possible for a user to perceive the current mode by merely touching the components arranged within the opening 95.

In addition, the respective handle operation directions can be perceived by checking the positions where the first body plates 11 are exposed to the outside. The back-and-forth length of the exposed portions of the first body plates 11 is the changeover stroke in the present embodiment. As can be seen from the drawings, each of the modes is performed with a constant changeover stroke. Therefore, it is possible to change over the current mode to another mode by operating the two handles simultaneously. In this way, by making different the shapes of the first handle operation portion 13 and the second handle operation portion 23, a user can easily perceive the relationship between the respective modes and the respective handles. This makes it possible to enhance the operability of the changeover operation device and to prevent the erroneous operation of the changeover operation device.

The shape of the first handle operation portion 13 and the second handle operation portion 23 is not limited to the one shown and described in respect of the second embodiment. The handle operation portions may have a "U" shape or a "T" shape. The shape of the handle operation portions may be suitably changed insofar as the advantageous effects of the present invention are obtainable. Needless to say, the handle operation portions may not be a grip type but may be an indentation type that can be held by a frictional pushing force.

While the invention has been shown and described with respect to the embodiments, it will be understood by those skilled in the art that various changes and modification may be made without departing from the scope of the invention as defined in the following claims.

What is claimed is:

1. A changeover operation device for changing over the positions of at least two components to establish three or more speed modes in a speed changer mechanism accommodated within a housing, comprising:

operation handles including a first and a second handle arranged in a corresponding relationship with the components, each of the operation handles being arranged to be moved between two specified positions within a same opening of the housing along a specified operation direction to change over the positions of the components, the operation handles being continuously arranged within the same opening and partially overlapped with the other, said two specified positions of each of the first handle and the second handle including a front position and a rear position, wherein the first handle is disposed at a front side of the changeover operation device and the second handle is positioned at a rear side of the changeover operation device, and wherein when the first handle is in the rear position of the first handle, the second handle engages the first handle and therefore is prevented by the first handle from being moved to the front position of the second handle.

2. The device of claim 1, wherein the operation handles include hidden portions selectively exposed in the respective speed modes, the hidden portions being provided with mode indicating portions indicative of the respective speed modes.

3. The device of claim 2, wherein the operation handles include a first handle and a second handle; and the speed modes include 3 modes, a first, a second and a third speed mode, which are specified by changing the first and the second handles between the two positions.

4. The device of claim 3, wherein the second handle has a first mode indicator visible on an upper surface of a front portion thereof when the second handle is in a rear position; the first handle has a second mode indicator visible on an upper surface of a front portion thereof when the first handle is in a rear position and the second handle is not overlapped with the first handle; and the first handle has a third mode indicator visible on an upper surface of a rear portion thereof when the first handle is in a front position.

5. The device of claim 1, wherein the housing includes marks provided in alignment with the two specified positions of the operation handles.

6. The device of claim 5, wherein the housing includes opposite side areas extending parallel to the operation direction to define said same opening, the marks being alternately arranged in the opposite side areas in a corresponding relationship with the operation handles.

7. The device of claim 6, wherein the operation handles include a first handle and a second handle; and the speed modes include 3 modes, a first, a second and a third speed mode, which are specified by changing the first and the second handles between the two positions.

8. The device of claim 7, wherein the second handle has a first mode indicator visible on an upper surface of a front portion thereof when the second handle is in a rear position; the first handle has a second mode indicator visible on an upper surface of a front portion thereof when the first handle is in a rear position and the second handle is not overlapped with the first handle; and the first handle has a third mode indicator visible on an upper surface of a rear portion thereof when the first handle is in a front position.

9. The device of claim 5, wherein the operation handles include a first handle and a second handle; and the speed modes include 3 modes, a first, a second and a third speed mode, which are specified by changing the first and the second handles between the two positions.

10. The device of claim 9, wherein the second handle has a first mode indicator visible on an upper surface of a front portion thereof when the second handle is in a rear position; the first handle has a second mode indicator visible on an upper surface of a front portion thereof when the first handle is in a rear position and the second handle is not overlapped with the first handle; and the first handle has a third mode indicator visible on an upper surface of a rear portion thereof when the first handle is in a front position.

11. The device of claim 1, wherein the operation handles differ in color from each other.

12. The device of claim 11, wherein the operation handles include a first handle and a second handle; and the speed modes include 3 modes, a first, a second and a third speed mode, which are specified by changing the first and the second handles between the two positions.

13. The device of claim 12, wherein the second handle has a first mode indicator visible on an upper surface of a front portion thereof when the second handle is in a rear position; the first handle has a second mode indicator visible on an upper surface of a front portion thereof when the first handle is in a rear position and the second handle is not overlapped with the first handle; and the first handle has a third mode indicator visible on an upper surface of a rear portion thereof when the first handle is in a front position.

14. The device of claim 1, wherein the operation handles differ in shape from each other.

15. The device of claim 14, wherein the operation handles include a first handle and a second handle; and the speed modes include 3 modes, a first, a second and a third speed mode, which are specified by changing the first and the second handles between the two positions.

16. The device of claim 15, wherein the second handle has a first mode indicator visible on an upper surface of a front portion thereof when the second handle is in a rear position; the first handle has a second mode indicator visible on an upper surface of a front portion thereof when the first handle is in a rear position and the second handle is not overlapped with the first handle; and the first handle has a third mode indicator visible on an upper surface of a rear portion thereof when the first handle is in a front position.

17. The device of claim 1, wherein the overlapped portions of the operation handles have a length greater than an operation stroke.

18. The device of claim 1, wherein each of the operation handles is movable between the two specified positions with the same operation stroke.

19. The device of claim 1, wherein the operation handles include a first handle and a second handle; and the speed modes include 3 modes, a first, a second and a third speed mode, which are specified by changing the first and the second handles between the two positions.

20. The device of claim 19, wherein the second handle has a first mode indicator visible on an upper surface of a front portion thereof when the second handle is in a rear position; the first handle has a second mode indicator visible on an upper surface of a front portion thereof when the first handle is in a rear position and the second handle is not overlapped with the first handle; and the first handle has a third mode indicator visible on an upper surface of a rear portion thereof when the first handle is in a front position.

* * * * *